US010808357B2

(12) United States Patent
Wu

(10) Patent No.: US 10,808,357 B2
(45) Date of Patent: Oct. 20, 2020

(54) DREDGING SLURRY SYSTEM WITH PULP TANK AND CONTROLLING METHOD OF THE SAME

(71) Applicant: YULAN GREEN TECHNOLOGY CO., LTD., Su'ao Township, Yilan County (TW)

(72) Inventor: Chih-Hao Wu, Su'ao Township, Yilan County (TW)

(73) Assignee: YULAN GREEN TECHNOLOGY CO., LTD., Su'ao Township, Yilan County (TW)

( * ) Notice: Subject to any disclaimer, the term of this patent is extended or adjusted under 35 U.S.C. 154(b) by 20 days.

(21) Appl. No.: 16/389,920

(22) Filed: Apr. 19, 2019

(65) Prior Publication Data

US 2020/0224366 A1 Jul. 16, 2020

(30) Foreign Application Priority Data

Jan. 11, 2019 (TW) ..... 108101155 A

(51) Int. Cl.

| | |
|---|---|
| ***D21D 5/02*** | (2006.01) |
| ***D21D 5/28*** | (2006.01) |
| ***B01F 3/12*** | (2006.01) |
| *D21J 3/00* | (2006.01) |

(52) U.S. Cl.

CPC ..... *D21D 5/02* (2013.01); *B01F 3/1271* (2013.01); *D21D 5/28* (2013.01); *B01F 2215/0078* (2013.01); *D21J 3/00* (2013.01)

(58) Field of Classification Search

USPC ..... 162/198, 263

See application file for complete search history.

(56) References Cited

U.S. PATENT DOCUMENTS

| | | | | |
|---|---|---|---|---|
| 2004/0013830 | A1* | 1/2004 | Nonomura | B32B 5/26 428/34.2 |
| 2016/0168800 | A1* | 6/2016 | Kuo | B22F 5/007 162/218 |
| 2016/0244917 | A1* | 8/2016 | Kuo | D21J 3/00 |
| 2016/0348314 | A1* | 12/2016 | Kuo | D21J 3/00 |
| 2019/0194870 | A1* | 6/2019 | Kuo | D21H 9/74 |
| 2019/0284764 | A1* | 9/2019 | Kuo | D21G 9/00 |

FOREIGN PATENT DOCUMENTS

| | | |
|---|---|---|
| TW | M513896 U | 12/2015 |

* cited by examiner

*Primary Examiner* — Mark Halpern
(74) *Attorney, Agent, or Firm* — Cheng-Ju Chiang

(57) ABSTRACT

A dredging slurry system with a pulp tank is introduced, which is applied for a wet paper pulp molding apparatus. The system comprises the pulp tank, a dredging slurry mold seat, an activating unit, a slurry-physical-feature detection unit and at least one inflow unit and a control unit. The slurry-physical-feature detection unit is used to detect at least one physical feature from a slurry within the pulp tank, during a plurality of different stages, thereby relatively outputting a physical feature data. The control unit is used to control the at least one inflow unit to a manner whether to pour a newly-added slurry into the pulp tank or not, depending upon the physical feature data.

12 Claims, 4 Drawing Sheets

DREDGING SLURRY SYSTEM WITH PULP TANK AND CONTROLLING METHOD OF THE SAME

FIELD OF THE INVENTION

The present invention relates to a dredging slurry system with a pulp tank and a controlling method of the same, and in particular, is related to a field of a paper pulp molding technology.

BACKGROUND OF THE INVENTION

Firstly, please refer to a Taiwanese utility model publication number M513,896 where a conventional design adopted for a pulp tank has several features as below. 1. Regarding "Overflow", in the conventional dredging slurry system with a pulp tank, it needs to continuously add a slurry into the conventional pulp tank and thereby make the slurry partially overflowed through a pipeline to the outside of the pulp tank; 2. Regarding "Reflow", the overflowed slurry as mentioned above would be collected for further adding into the pulp tank again through another pipeline; and 3. Regarding "Stirring", the slurry is continuously overflowing and reflowing in cycles, hence, for avoiding uneven distribution of pulp-fiber concentration in the overflowing and/or reflowing slurry, wherein the uneven concentration of the slurry need to be stably maintained by continuously blowing the air into the slurry to mix, with a pumping equipment (such as pumps). However, because the conventional dredging slurry system with the pulp tank requires at least an overflow output pump (for extraction of the overflowed slurry with electric driven pumps), a reflowing bucket (for reloading the overflowed slurry thereto), and a reflowing pipeline (for conveying the overflowed slurry) and an electric drive reflowing pump (for re-adding the slurry stored in the reflowing bucket into the pulp tank) and an electric air pumping equipment (for stirring the slurry). These overflow-output slurry pipelines and their associated equipments, and these reflow-input slurry pipelines and their associated equipments constitutes a bidirectional fluid communication between the conventional pulp tank and its exterior, as forming a slurry supply circulation.

However, the slurry supply circulation needs to spend a large amount of the electricity and equipment costs for continuously maintaining both of the overflow and the reflow of the slurries. In the inventor's thoughtfulness, it is expected to reduce the electricity and equipment costs incurred for the conventional dredging slurry system with the pulp tank.

For that, it is required to improve the technical issues how to solve the large electrical and equipment costs spent for the conventional dredging slurry system with the pulp tank.

Accordingly, it is essential to provide a dredging slurry system with a pulp tank and a controlling method of the system, so as to solve the technical issues of the above-mentioned conventional art.

SUMMARY OF THE INVENTION

In order to solve the aforementioned technical problems of the conventional art, an objective of the present invention is to provide a dredging slurry system with a pulp tank, which has the following advantages, comprising: (1) The pulp tank merely has an unidirectional fluid communication to its exterior thereof, so that it is capable to removing therefrom a number of pipelines and equipment relative to the overflows and reflows of the slurries, which are required to form the slurry supply circulation of the conventional art with the bidirectional fluid communication to the exterior of the pulp tank, and at the same time, the electricity cost and the equipment cost can be minimized; and (2) By the present invention, the dredging slurry system with the pulp tank can efficiently add the slurry as needed, instead of non-stopping the continuity of supplying the slurries in the conventional art, and can also remove the pumping equipment therefrom, thereby further reducing the electricity costs and the equipment costs.

In order to achieve the objective, the present invention provides a dredging slurry system with a pulp tank, which is applied for a paper pulp molding equipment. The dredging slurry system comprises the pulp tank, a dredging-slurry die base, an activating unit, a slurry-physical-feature detection unit, at least one inflow unit and a control unit.

The pulp tank is constructed of a plurality of tank walls which jointly define a storage space for storing a slurry therein. The dredging-slurry die base is disposed with at least one dredging die.

During a plurality of different stages, the activating unit is used for driving the dredging-slurry die base to descend until the at least one dredging die is sunk below a liquid-surface of the slurry within the pulp tank and thereby dredging a portion of the slurry into the at least one dredging die, or the activating unit is used for driving the dredging-slurry die base to ascend from below the slurry-liquid-surface until above the slurry-liquid-surface.

The slurry-physical-feature detection unit is configured to detect at least one physical feature of the slurry within the pulp tank during the plurality of different stages, and to output a physical feature data corresponding to the at least one physical feature.

The at least one inflow unit is used for selectively pouring a newly-added slurry into the pulp tank through at least one inlet of the pulp tank.

The control unit is configured to activate on driving of the at least one inflow unit, for pouring the newly-added slurry into the pulp tank, when the physical feature data meets with a first condition, and to activate off driving of the at least one inflow unit, for ceasing pouring the newly-added slurry into the pulp tank, when the physical feature data meets with a second condition.

In a preferred embodiment, the slurry-physical-feature detection unit is at least one pressure meter, the at least one physical feature is a liquid pressure of the slurry within the pulp tank, the physical feature data is a real slurry liquid pressure value.

In a preferred embodiment, the first condition is that the real slurry liquid pressure value is less than a first preset slurry liquid pressure value, and the second condition is that the real slurry liquid pressure value is larger than or equal to the first preset slurry liquid pressure value.

In a preferred embodiment, the control unit generates a real slurry-liquid-surface level value according to the real slurry liquid pressure value, the first condition is that the real slurry-liquid-surface level value is less than a first preset slurry-liquid-surface level value, and the second condition is that the real slurry-liquid-surface level value is larger than or equal to the first preset slurry-liquid-surface level value.

In a preferred embodiment, the slurry-physical-feature detection unit is at least one depth detector, the at least one physical feature is a slurry-liquid-surface level of the slurry within the pulp tank, the physical feature data is a real slurry-liquid-surface level value.

In a preferred embodiment, the first condition is that the real slurry-liquid-surface level value is less than a first preset slurry-liquid-surface level value, and the second condition is that the real slurry-liquid-surface level value is larger than or equal to the first preset slurry-liquid-surface level value.

In a preferred embodiment, after the control unit activates off driving of the at least one inflow unit, for ceasing pouring the newly-added slurry into the pulp tank, the control unit controls the activating unit to drive the dredging-slurry die base to descend until the at least one dredging die is sunk below a liquid-surface of the slurry within the pulp tank, for dredging a portion of the slurry into the at least one dredging die.

In a preferred embodiment, the dredging slurry system with the pulp tank, further comprises a vacuum device fluid-communicated to the dredging-slurry die base, wherein the control unit controls the vacuum device to evacuate a solvent contained in the slurry dredged in the at least one dredging die of the dredging-slurry die base by a vacuum pressure, except only retaining a solid matter contained in the slurry within the at least one dredging die.

In a preferred embodiment, an error value between dried weights of the solid matter retained in each two of the at least one dredging die, in relation to a desired weight, is within plus or minus 3%.

In a preferred embodiment, when the physical feature data meets with a third condition, the control unit controls the activating unit to drive the dredging-slurry die base to ascend above the slurry-liquid-surface.

In a preferred embodiment, the third condition is that the slurry-liquid-surface level value is less than or equal to a second preset slurry-liquid-surface level value and/or a capacity of the evacuated solvent is equal to a preset capacity.

In a preferred embodiment, the pulp tank merely has a unidirectional fluid communication to an exterior thereof, by means of arrangement of the at least one inflow unit.

In order to achieve the object, the present invention provides a controlling method for a dredging slurry system with a pulp tank, which is applied for a paper pulp molding equipment. The controlling method comprises the following steps of: firstly a slurry-physical-feature detection unit detecting at least one physical feature of a slurry within the pulp tank during a plurality of different stages, and thereby outputting a physical feature data corresponding to the at least one physical feature; then, a control unit activates on driving of at least one inflow unit to pour a newly-added slurry into the pulp tank, when the control unit determines that the physical feature data meets with a first condition; then, the control unit activating off driving of the at least one inflow unit, for ceasing pouring the newly-added slurry into the pulp tank, when the control unit determines that the physical feature data meets with a second condition.

In a preferred embodiment, after the control unit activates off driving of the at least one inflow unit, for ceasing pouring the newly-added slurry into the pulp tank, an activating unit is controlled by the control unit, for driving a dredging-slurry die base to descend until at least one dredging die of the dredging-slurry die base is sunk below a liquid-surface of the slurry within the pulp tank, for dredging a portion of the slurry into the at least one dredging die.

In a preferred embodiment, the control unit controls a vacuum device evacuates a solvent contained in the slurry dredged in the at least one dredging die of the dredging-slurry die base by a vacuum pressure, except only retaining a solid matter contained in the slurry within the at least one dredging die, wherein the vacuum device is fluid-communicated to the dredging-slurry die base, and then the control unit controls the activating unit to drive the dredging-slurry die base to ascend above the slurry-liquid-surface when the physical feature data meets with a third condition.

In a preferred embodiment, the physical feature data is a real slurry-liquid-surface level value, the first condition is that the real slurry-liquid-surface level value is less than a first preset slurry-liquid-surface level value, the second condition is that the real slurry-liquid-surface level value is larger than or equal to the first preset slurry-liquid-surface level value, and the third condition is that the slurry-liquid-surface level value is less than or equal to a second preset slurry-liquid-surface level value and/or a capacity of the evacuated solvent is equal to a preset capacity.

In a preferred embodiment, the physical feature data is a real slurry liquid pressure value, the first condition is that the real slurry liquid pressure value is less than a first preset slurry liquid pressure value, the second condition is that the real slurry liquid pressure value is larger than or equal to the first preset slurry liquid pressure value, and the third condition is that the slurry liquid pressure value is less than or equal to a second preset slurry liquid pressure value and/or a capacity of the evacuated solvent is equal to a preset capacity.

The advantageous effects provided by the present invention are that: compared with the conventional art, the present invention adopts significant technical solutions without reflow and stirring for the slurry, which has below advantages that: 1. By completely removing equipments required for reflow, the electricity costs and equipment costs both are minimized; 2. By changing the timings of newly-adding the slurry, a pumping equipment can be removed to further reduce the electricity cost.

DESCRIPTION OF THE DIAGRAMS

DETAILED DESCRIPTION OF THE PREFERRED EMBODIMENTS

The technical proposals in the embodiments of the present invention will be clearly and completely described in the following with reference to the accompanying drawings of the embodiments of the present invention. It is apparent that the described embodiments are only a part of the embodiments of the present invention, but not all of the embodiments of the present invention. The scope of the claims is not limited to the embodiments described, but is defined by the claims. All other embodiments are obtained by a person of ordinary skill in the art based on the embodiments of the present invention without creative efforts are within the scope of the present invention.

Figure 1:
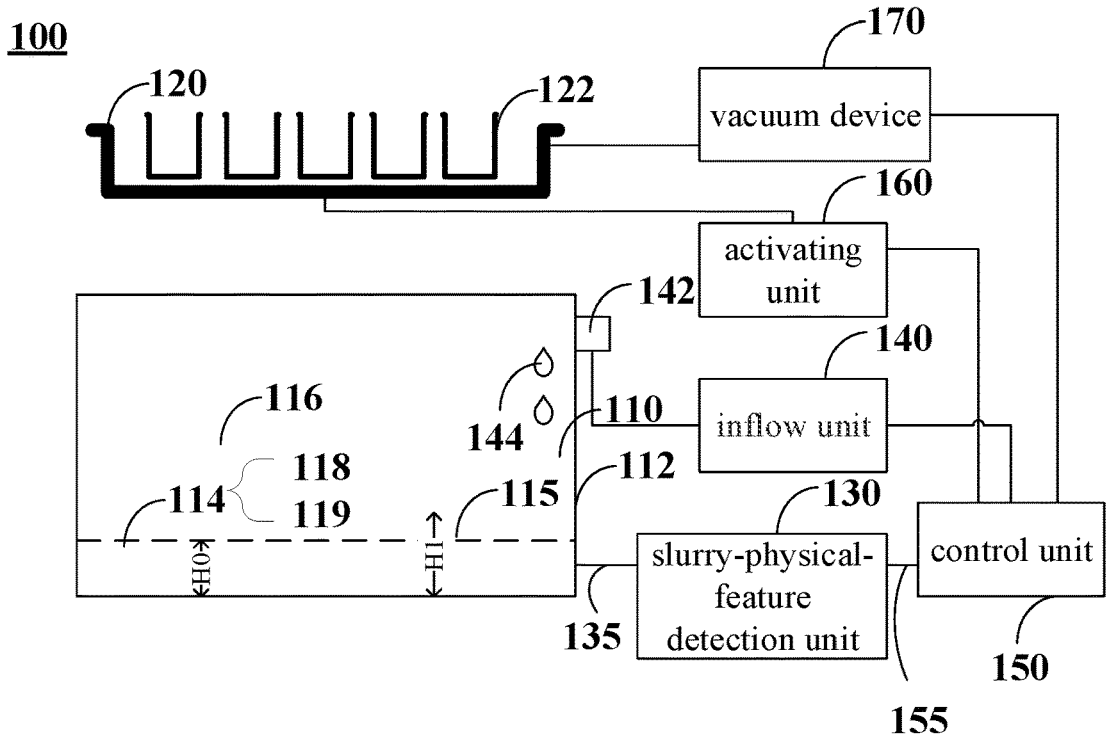
FIG. 1 depicts an operationally schematic diagram of a dredging slurry system with a pulp tank in a first stage, according to a preferred embodiment of the present invention.

FIG. 1 depicts an operationally schematic diagram of a dredging slurry system 100 with a pulp tank 110 in a first stage, according to a preferred embodiment of the present invention. The dredging slurry system 100 is applied for a paper pulp molding equipment or process. The dredging slurry system 100 comprises the pulp tank 110, a dredging-slurry die base 120, a slurry-physical-feature detection unit 130, at least one inflow unit 140, a control unit 150, an activating unit 160 and a vacuum device 170.

The pulp tank 110 is constructed of a plurality of tank walls 120 which jointly define a storage space 116 for storing a slurry 114 therein. The at least one inflow unit 142 are formed on the plurality of tank walls, and further there is an opening (unlabeled) formed on top of the pulp tank 110. At least one dredging die 122 is fixedly disposed within the dredging-slurry die base 120. The at least one dredging die 122 is replaceable according to different products (different products have different shapes, thicknesses, etc.). When the dredging-slurry die base 120 passes through the opening of the pulp tank 110, the at least one dredging die 122 is sunk into the pulp tank 110, for dredging the slurry 114 therein. In another preferred embodiment, the at least one dredging die comprises a plurality of dredging dies which are evenly disposed inside the dredging-slurry die base 120. In still another preferred embodiment, a plurality of through holes are formed inside the at least one dredging die 122 to assist the vacuum device 170 to accelerate the extraction of a solvent 118 (such as a water) contained in the slurry 144, except only retaining a solid matter 119 (such as pulp fibers) contained in the slurry 114 inside the at least one dredging die 122.

In a preferred embodiment, the slurry 114 can be composed of water, fibers, and some chemical agents, and the herein-called solvent 118 generally comprises the water. For example, the slurry 114 mentioned in the preferred embodiment comprises a water-based solvent 118, and a "paper pulp" which composed of a pulp-fiber-based solid matter 119 and a chemical agent (e.g. a leveling agent). Hence, the slurry 114 is not limited to contain only pulp fibers but may also be a heterogeneous slurry composed of different solvents 118 (such as a volatile solvent, etc.) and other solid matters 119 (such as plastic fibers, glass fibers, etc.).

During a plurality of different stages (as shown in FIGS. 1-5), the activating unit 106 is used for driving the dredging-slurry die base 120 to descend until the at least one dredging die 122 is sunk below a slurry-liquid-surface 115 of the slurry 114 within the pulp tank 110, for dredging a portion of the slurry 114 into the at least one dredging die 122, or the activating unit 160 is used for driving the dredging-slurry die base 120 to ascend from below the slurry-liquid-surface 115 until above the slurry-liquid-surface 115. In a preferred embodiment, the activating unit 160 may be an existing power-driving assembly including, but not limited to, one or a combination of a motor, a guide rod, a pressure cylinder, a boom, a chain belt, and a gear.

The slurry-physical-feature detection unit 130 is configured to regularly or irregularly detect at least one physical feature 135 of the slurry 114 within the pulp tank 110, during a plurality of different stages, and then outputs a physical feature data 155, corresponding to the at least one physical feature 135, via a wire or wireless.

The at least one inflow unit 140 is configured to pour a newly-added slurry 144 into the storage space 116 of the pulp tank 110 via the at least one inlet 142 of the pulp tank 110. In a preferred embodiment, the at least one inflow unit 140 can be one or a combination of an adjustable valve, a switch, and a pump. It should be particularly noted herein that the newly-added slurry 144 and the slurry 114 have substantially the same composition, and respectively use different component reference numerals herein in order to clearly understand that the newly-added slurry 144 is poured into the storage space 116 of the pulp tank 110 via the at least one inflow unit 140, and the slurry 114 is originally stored in the storage space 116 of the pulp tank 110. By the arrangement of the at least one inflow unit 140, the pulp tank 110 can be accomplished with only one unidirectional fluid communication to the exterior thereof. Briefly, the present invention provides technical advantages that: the newly-added slurry 144 is conveyed only along a single direction from the at least one inflow unit 140 into the pulp tank 110, instead of bidirectional fluid-communication to the exterior of the pulp tank, so that the related pipelines and equipment used in the conventional art (such as overflows and reflows required for the slurry supply circulation) can be removed, thereby minimizing its electricity and equipment costs.

The control unit 150 is configured to activate on driving of the at least one inflow unit 140, for pouring a newly-added slurry 144 into the pulp tank 110, when the physical feature data 155 meets with a first condition, and to activate off the driving of the at least one inflow unit 140, for ceasing pouring the newly-added slurry 144 into the pulp tank 110, when the physical feature data 155 meets with a second condition. In a preferred embodiment, the control unit 150 is a programmable controller for determining whether the physical feature data 155 is consistent with the first condition or the second condition such that the control unit 150 further controls the driving of the at least one inflow unit 140, for pouring or ceasing the pouring of the newly-added slurry 144 into the pulp tank 110. Briefly, the slurry dredging system with the pulp tank 100 in accordance with the present invention provides the technical advantages that: by primarily determining the physical feature data 155 (e.g., whether the slurry 114 reaches a sufficient liquid level or liquid pressure) of the slurry 114 within the pulp tank 110, it is decided whether to necessarily add the newly-added slurry 144, instead of continuously supplying the newly-added slurry 144, thereby removing the air pumping equipment used in the conventional art, for further reducing the electricity and equipment cost.

In the actuation control, after the control unit 150 receives the physical feature data 155 output by the slurry-physical-feature detection unit 130, the control unit 150 respectively sends a corresponding command to the at least one inflow unit 140, the activating unit 160 and the vacuum device 170, for respectively performing corresponding required operations, as described below.

After the control unit 150 determines that the physical feature data meets with the second condition and thereby activates off the driving of the at least one inflow unit 140, for ceasing pouring the newly-added slurry 144 into the pulp tank 110, the control unit 150 controls the activating unit 160 for driving the dredging-slurry die base 120 to descend until the at least one dredging die 122 is sunk below the slurry-liquid-surface 115 of the slurry 114 within the pulp tank 110, for dredging a portion of the slurry 114 into the at least one dredging die 122.

The vacuum device 170 is fluid-communicated to the dredging-slurry die base 120. After the dredging-slurry die base 120 is descended unit the at least one dredging die 122 is sunk below the slurry-liquid-surface 115 of the slurry 114 within the pulp tank 110, for dredging a portion of the slurry 114 into the at least one dredging die 122, the control unit 150 controls the vacuum device 170 to evacuate a solvent 118 contained in the slurry 114 dredged within the at least one dredging die 122 of the dredging-slurry die base 120 by a vacuum pressure, except only retaining a solid matter 119 contained in the slurry 114 in the at least one dredging die 122.

Preferably, see a Table 1 below, which shows a statistic table of the dried weights (i.e. completely-dried solid weights) of the solid matters 119 in each of the at least one dredging die 122 after three-time operations of the dredging slurry system 100 with the pulp tank 110 of the present invention. In the table 1, twelve pieces of dredging dies 122 (as the respective dredging dies A to L) are respectively disposed within one dredging-slurry die base 120. It is assumed that an ideal dried weight of the solid matter 119 of the respective dredging die 122 is 70 grams. For example, in the first operation, the dried weight of the solid matter 119 inside the dredging die A is 71.2 grams, and the dried weight of the solid matter 119 of the dredging die G is 70.6 grams, and an error value between the two dried weights in relation to the ideal dried weight is 0.8% (i.e., the error value=(71.2−70.6)/70). According to the experiment in the Table 1 below, the error value between the dried weight of the solid matter 119 obtained by each two of the dredging dies (A~L) can be conservatively controlled within plus or minus 3%. It means that the dredging slurry system 100 with the pulp tank 110 of the present invention is capable of reducing the difference between the dried weights of the solid matters 119 of different dredging dies (A~L) in each of the dredging-slurry die base 120, in relation to an ideal dried weight. However, the ideal dried weights of the solid matters 119 are changeable depending on demands for different products.

TABLE 1

| Dredging die | Dried weight of $1^{st}$ operation (gram) | Dried weight of $2^{nd}$ operation (gram) | Dried weight of $3^{rd}$ operation (gram) | Mean difference of dried weights (percentage) |
|---|---|---|---|---|
| A | 71.2 | 70.5 | 71.5 | 1.52% |
| B | 71.3 | 70.2 | 70.8 | 1.10% |
| C | 69.2 | 68.4 | 68.4 | −1.90% |
| D | 69.7 | 68.3 | 70.7 | −0.62% |
| E | 69.4 | 68.6 | 70.6 | −0.67% |
| F | 70.5 | 69.2 | 69.0 | −0.62% |
| G | 70.6 | 70.9 | 71.5 | 1.43% |
| H | 70.8 | 69.7 | 71.3 | 0.86% |
| I | 70.2 | 69.2 | 69.2 | −0.67% |
| J | 69.4 | 69.1 | 68.4 | −1.48% |
| K | 69.9 | 68.8 | 69.1 | −1.05% |
| L | 68.9 | 68.7 | 67.9 | −2.14% |

In a preferred embodiment, the slurry-physical-feature detection unit 130 is configured to be a depth detector, the at least one physical feature 135 is a real slurry-liquid-surface level value H0 of the slurry 114 within the pulp tank 110, the physical feature data 155 means the real slurry-liquid-surface level value H0 (For the sake of convenience, the component numeral H0 of the real slurry-liquid-surface level value is used as the component numeral of the real slurry-liquid-surface level value, and so on). In a preferred embodiment, the slurry-physical-feature detection unit 130 can be an Infrared sensor. In another preferred embodiment, the slurry-physical-feature detection unit 130 can be a pressure meter, and the at least one physical feature that is detected is a real liquid pressure value of the slurry 114 within the pulp tank 110. Furthermore, the control unit 150 can calculate the real liquid pressure level to derive a corresponding real slurry-liquid-surface level value. With pre-programming of the control unit 150, the first condition is that the real slurry-liquid-surface level value H0 is less than a first preset slurry-liquid-surface level value H1, and the second condition is that the real slurry-liquid-surface level value H0 is larger than or equal to the first preset slurry-liquid-surface level value H1.

In another preferred embodiment, the slurry-physical-feature detection unit 130 can be a pressure meter, the at least one physical feature 135 is a liquid pressure of the slurry 114 within the pulp tank 110, and the physical feature data 155 is a real slurry liquid pressure value. In another preferred embodiment, the slurry-physical-feature detection unit 130 can be a depth detector (such as Infrared sensor), the at least one physical feature 135 that is detected is a liquid pressure of the slurry 114 within the pulp tank 110, and the physical feature data 155 is the real slurry-liquid-surface level value H0. It is possible to derive the corresponding real slurry liquid pressure value with respect to the real slurry-liquid-surface level value H0 by the control unit 150. With pre-programming of the control unit 150, the first condition is that the real slurry liquid pressure value is less than a first preset slurry liquid pressure value, and the second condition is that the real slurry liquid pressure value is larger than or equal to the first preset slurry liquid pressure value.

In a preferred embodiment, when the physical feature data 155 meets with a third condition, the control unit 150 controls the activating unit 160, for driving the dredging-slurry die base 120 to ascend above the slurry-liquid-surface 115. With pre-programming of the control unit 150, the third condition is that the real slurry-liquid-surface level value H0 is less than or equal to a second preset slurry-liquid-surface level value H2 (see FIG. 4) and/or a capacity of the evacuated solvent 118 is equal to a preset capacity. In another preferred embodiment, with pre-programming of the control unit 150, the third condition is that the real slurry liquid pressure value is less than or equal to a second preset slurry liquid pressure value and/or a capacity of the evacuated solvent 118 is equal to a preset capacity.

It should be particularly noted that the real slurry-liquid-surface level value H0 detected by the slurry physical feature detecting unit 130 during the different stages (see FIGS. 1 to 5) of the present invention, is continuously varied. However, in the control unit 150, the first preset slurry-liquid-surface level value H1 and the second slurry-liquid-surface level value H2 (see FIG. 4) can be varied according to different designs (e.g. its size, shape, etc.) for the pulp tank 110, the dredging-slurry die base 120, the at least one dredging die 122, and product specifications. For example, furthermore under a situation that the same slurry 114, the pulp tank 110, the dredging-slurry die base 120, the at least one dredging die 122 and the first preset slurry-liquid-surface level value H1 all are used the same, if the second preset slurry-liquid-surface level value H2 is adjusted higher or the preset capacity is adjusted lower, it is realized that the solid matter 119 within the at least one dredging die 122 will be correspondingly decreased; namely, the thickness of the products will be decreased.

Please further refer to FIGS. 1-5, which respectively illustrate a series of actuation stages of the slurry dredging system 100 with the pulp tank 110 according to the present invention.

In the first stage as shown in FIG. 1, when the control unit 150 determines that the real slurry-liquid-surface level value H0, output by the slurry-physical-feature detection unit 130, meets with the first condition (the real slurry-liquid-surface level value H0 is less than the first preset slurry-liquid-surface level value H1), the control unit 150 controls the at least one inflow unit 140 to pour the newly-added slurry 144 into the pulp tank 110.

Figure 2:
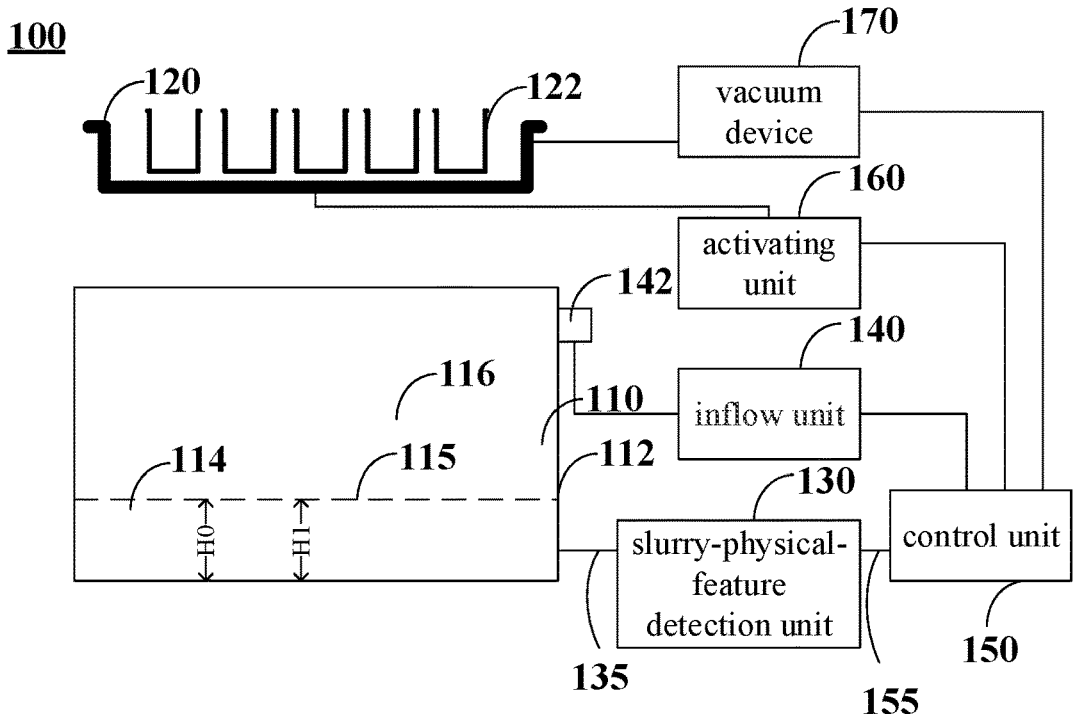
FIG. 2 depicts an operationally schematic diagram of the dredging slurry system with the pulp tank, as shown in FIG. 1, which is in a second stage.

In the second stage as shown in FIG. 2, when the control unit 150 determines that the real slurry-liquid-surface level value H0, output by the slurry-physical-feature detection unit 130, meets with the second condition (the real slurry-liquid-surface level value H0 is larger than or equal to the first preset slurry-liquid-surface level value H1), the control unit 150 controls the at least one inflow unit 140 to cease pouring the newly-added slurry 144 (FIG. 1) into the pulp tank 110. It should be noted that, in actual operation, it may happen that too much newly-added slurry 144 is poured, so the error value range of the pouring amount is controlled within 2%.

Figure 3:
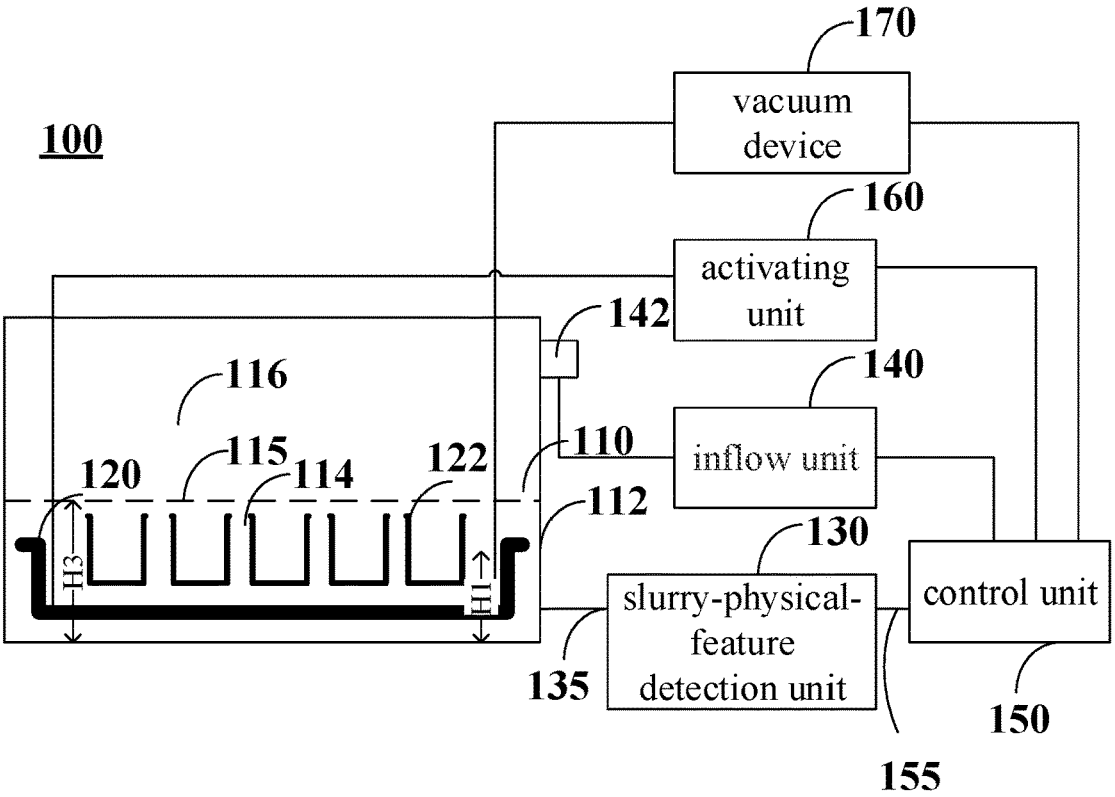
FIG. 3 depicts an operationally schematic diagram of the dredging slurry system with the pulp tank, as shown in FIG. 1, which is in a third stage.

In the third stage as shown in FIG. 3, the control unit 150 controls the activating unit 160, for driving the dredging-slurry die base 120 to descend below the slurry-liquid-surface 115 and thereby performing a dredging process. At this time, due to the squeeze of the slurry die base 120, the real slurry-liquid-surface level of the slurry 114, detected and output by the slurry-physical-feature detection unit 130, is raised from H0 (as shown in FIG. 2) to H3 (as shown in FIG. 3). Generally, the real slurry-liquid-surface level value H3 will be larger than the first preset slurry-liquid-surface level value H1. It is noted that the third stage is processed immediately after the second stage is finished.

Figure 4:
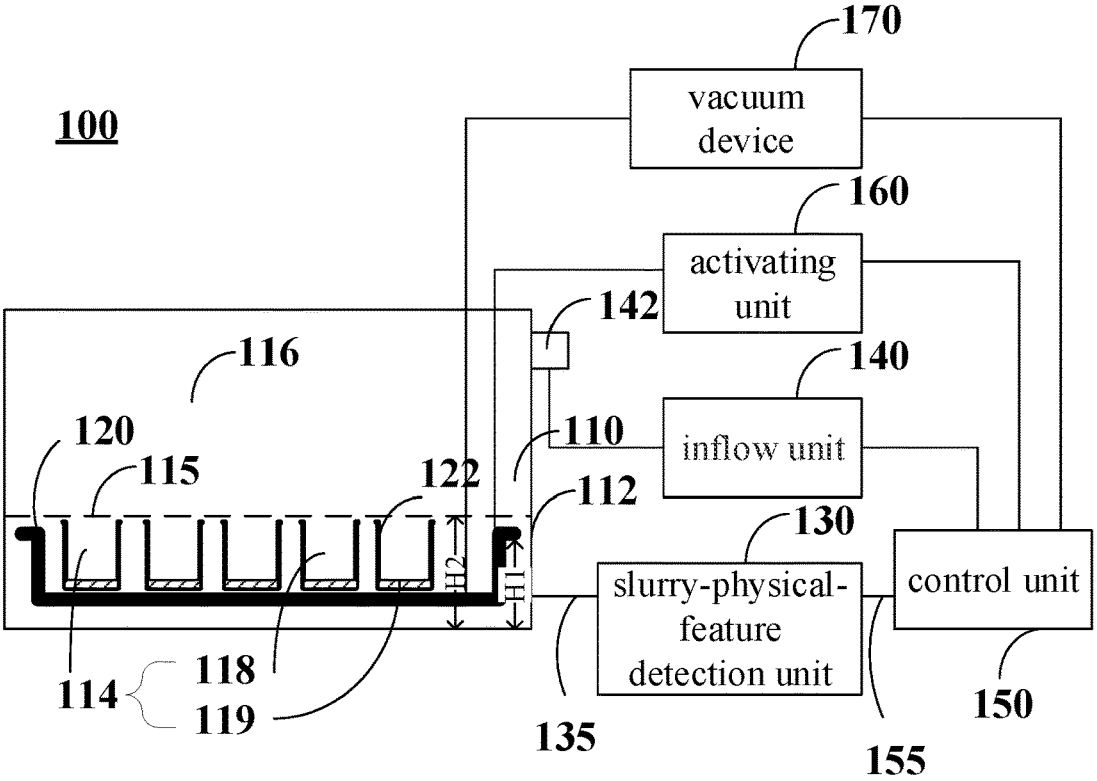
FIG. 4 depicts an operationally schematic diagram of the dredging slurry system with the pulp tank, as shown in FIG. 1, which is in a fourth stage.

In the fourth stage as shown in FIG. 3, the vacuum device 170 vacuum evacuates the solvent 118 in the slurry 114 except that a portion of the solid matter 119 are retained to the at least one dredging die 122, and the real slurry-liquid-surface level value, detected and output by the slurry-physical-feature detection unit 130, is decreased form H3 (as shown in FIG. 3) to the second preset slurry-liquid-surface level value H2 (as shown in FIG. 4). In the preferred embodiment, when the control unit 150 determines that the real slurry-liquid-surface level value, output by the slurry-physical-feature detection unit 130, meets with the third condition (e.g. the third condition is that the real slurry-liquid-surface level value is less than or equal to a second preset slurry-liquid-surface level value H2 and/or a capacity of the evacuated solvent 118 is equal to a preset capacity, the slurry dredging system 100 with the pulp tank 110 will determine that the dredging process is finished.

For example, the real slurry-liquid-surface level value is decreased from 1.5 meter (the real slurry-liquid-surface level value H0) to 1.0 meter (the second preset slurry-liquid-surface level value H2) and/or a capacity of the evacuated solvent 118 is equal to 150 liters, then the dredging process is determined to be finished. It is possible to apply two determining methods or only one method. In FIG. 4, the second preset slurry-liquid-surface level value H2 is larger than the first preset slurry-liquid-surface level value H1; however, a relationship between the first preset slurry-liquid-surface level value H1 and the second slurry-liquid-surface level value H2 will be affected by different parameters. The control unit 150 will perform the above operation depending upon the variations (getting smaller or larger) of the real slurry-liquid-surface level value, with incorporating the first preset slurry-liquid-surface level value H1 and the second slurry-liquid-surface level value H2.

Figure 5:
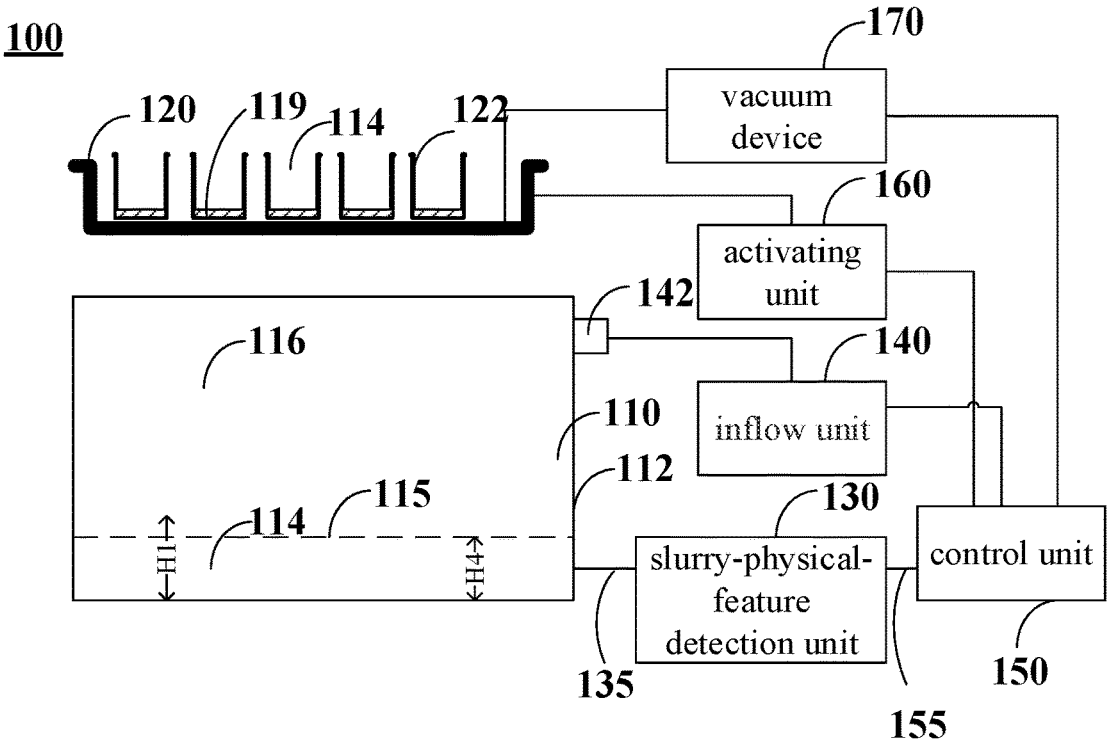
FIG. 5 depicts an operationally schematic diagram of the dredging slurry system with the pulp tank, as shown in FIG. 1, which i in a fifth stage.

In the fifth stage as shown in FIG. 5, the control unit 150 controls the activating unit 160 to drive the dredging-slurry die base 120 to ascend until the at least one dredging die 122 is moved above the slurry-liquid-surface 115, thereby finishing the dredging process. As mentioned, the relationship is introduced between the first preset slurry-liquid-surface level value H1 and the second slurry-liquid-surface level value H2 is shown in FIG. 4. In FIG. 5, the real slurry-liquid-surface level value H4, output by the slurry-physical-feature detection unit 130, is less than the first preset slurry-liquid-surface level value H1; however, in actual operation, the relationship between the real slurry-liquid-surface level value H4 and the first preset slurry-liquid-surface level value H1 can be preset according to different parameters.

Figure 6:
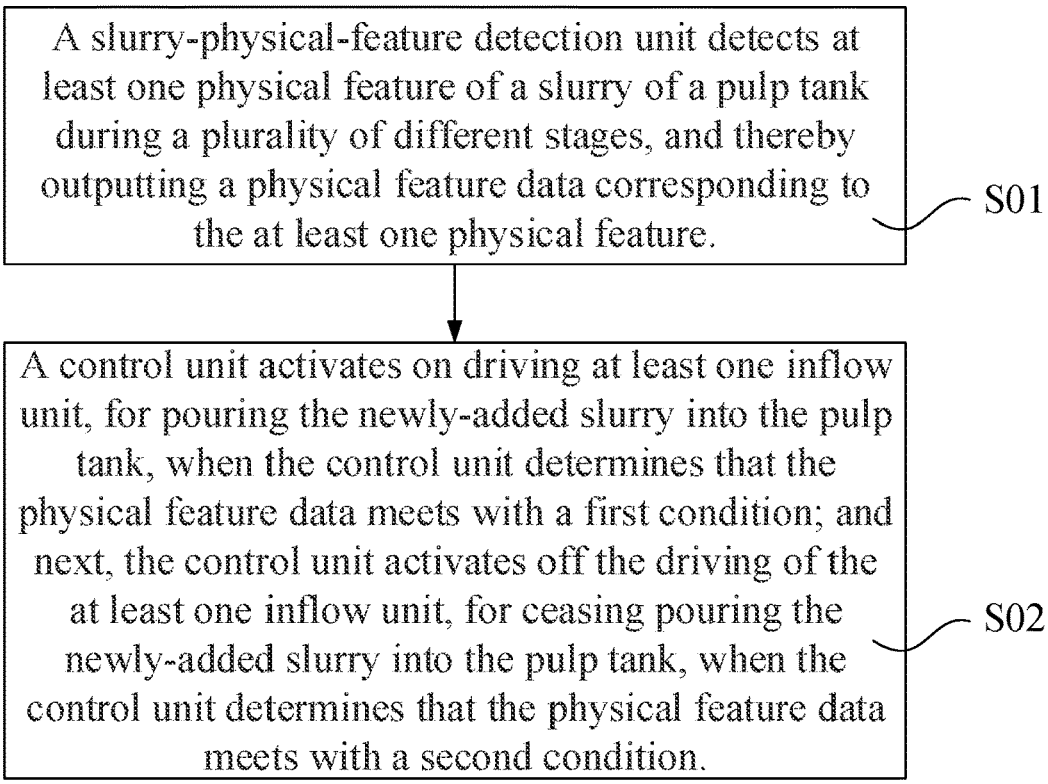
FIG. 6 depicts a flow chart of a controlling method for a dredging slurry system with a pulp tank, according to a first preferred embodiment of the present invention.

FIG. 6 depicts a flow chart of the controlling method for a dredging slurry system 100 with a pulp tank 110, according to a first preferred embodiment of the present invention. For the components of the slurry dredging system 100 with the pulp tank 110 and their component numerals mentioned in FIG. 6, please refer to the illustrations of FIGS. 1-5, and the details will be not described below.

The controlling method is described below. Firstly, in a performed step S01, a slurry-physical-feature detection unit 130 detects at least one physical feature 135 of a slurry 114 of a pulp tank 110 during a plurality of different stages, and thereby outputting a physical feature data 155 corresponding to the at least one physical feature 135. It is noted that the slurry-physical-feature detection unit 130 of the present embodiment could be a depth detector and/or a pressure meter.

Next, in a performed step S02, a control unit 150 activates on driving of at least one inflow unit 140, for pouring the newly-added slurry 144 into the pulp tank 110, when the control unit 150 determines that the physical feature data 155 meets with a first condition; and next, the control unit 150 activates off the driving of the at least one inflow unit 140, for ceasing pouring the newly-added slurry 144 into the pulp tank 110, when the control unit 150 determines that the physical feature data 155 meets with a second condition. In one preferred embodiment, the physical feature data 155 is a real slurry-liquid-surface level value H0, the first condition is that the real slurry-liquid-surface level value H0 is less than a first preset slurry-liquid-surface level value H1, and the second condition is that the real slurry-liquid-surface level value H0 is larger than or equal to the first preset slurry-liquid-surface level value H1. In another preferred embodiment, the physical feature data 155 is a real slurry liquid pressure value, the first condition is that the real slurry liquid pressure value is less than a first preset slurry liquid pressure value, and the second condition is that the real slurry liquid pressure value is larger than or equal to the first preset slurry liquid pressure value. For example, taking the slurry-physical-feature detection unit 130 as a depth detector, the control unit 150 decides whether to add a portion of the newly-added slurry 144 according to the slurry-liquid-surface level values H0, H3 and H4, instead of continuously adding and reflowing the slurry 114; hence, a certain-level intellectualization can be achieved, thereby removing the slurry supply circulation used in the conventional art, and then decreasing the consumption of electricity.

Figure 7:
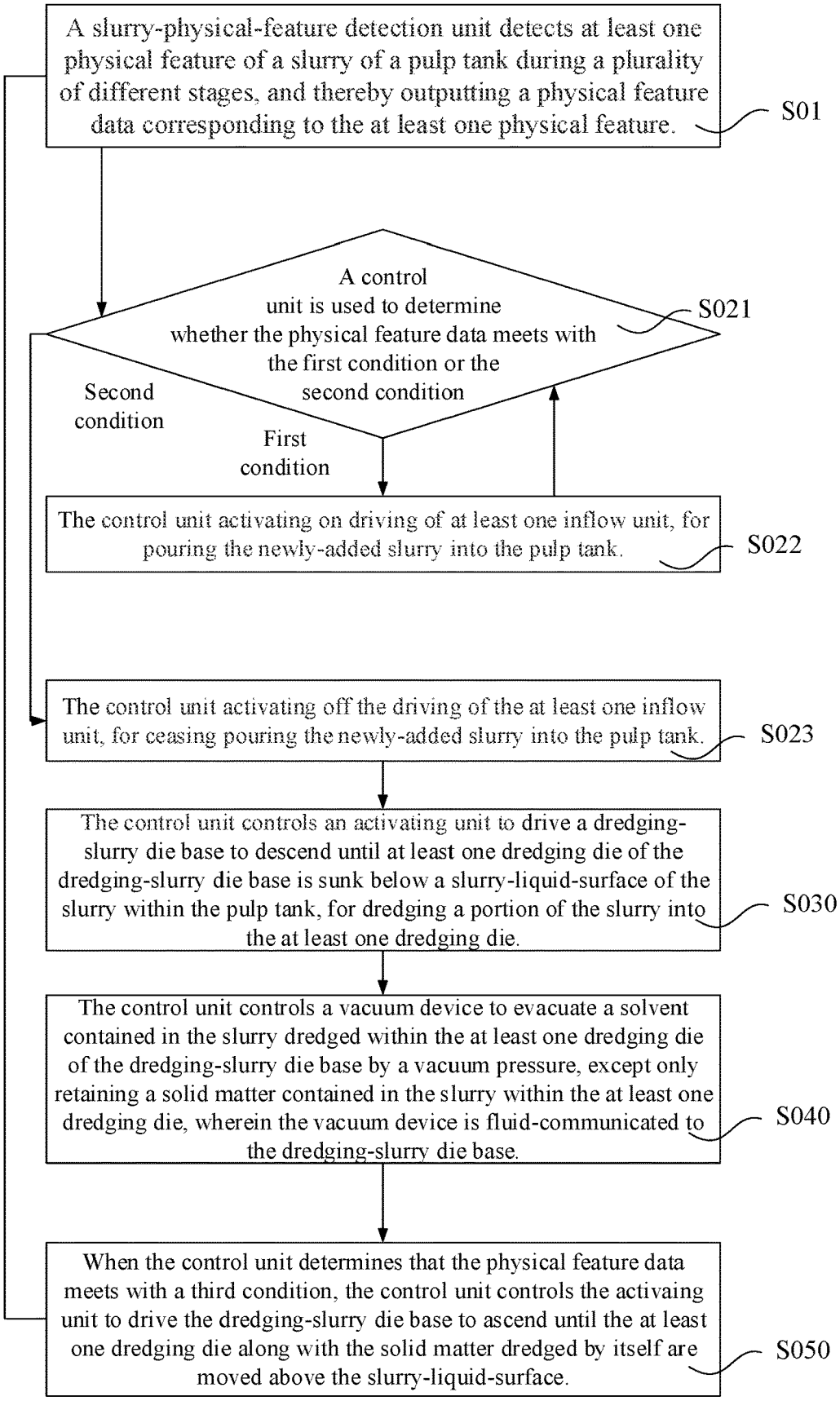
FIG. 7 depicts a flow chart of a controlling method for a dredging slurry system with a pulp tank, according to a second preferred embodiment of the present invention.

FIG. 7 depicts a flow chart of the controlling method for a dredging slurry system 100 with a pulp tank 110, according to a second preferred embodiment of the present invention.

For the components of the slurry dredging system 100 with the pulp tank 110 and their component numerals mentioned in FIG. 7, please refer to FIGS. 1-5, and the details will be not described below.

The controlling method is described below. Firstly, in the performed step S01, a slurry-physical-feature detection unit 130 detects at least one physical feature 135 of slurry 114 of a pulp tank 110 during a plurality of different stages, and thereby outputting a physical feature data 155 corresponding to the at least one physical feature 135. It is noted that the slurry-physical-feature detection unit 130 of the present embodiment could be a depth detector and/or a pressure meter. In other words, the at least one physical feature 135 means a level, and the slurry-physical-feature detection unit 130 of the present embodiment is used to detect a liquid-surface level of the slurry 114 within the pulp tank 110.

Next, in a performed step S021, a control unit 150 is used to determine whether the physical feature data 155 meets with the first condition or the second condition. In other words, the control unit 150 determines whether the level is lower than a first preset slurry-liquid-surface level value H1 or not. If the physical feature data 155 meets with the first condition, a step S022 is performed, which comprises: the control unit 150 activating on driving of at least one inflow unit 140, for pouring the newly-added slurry 144 into the pulp tank 110.

Next, performing the step S021 again, if the physical feature data 155 still meets with the first condition, the step S022 is continuously performed; otherwise, a step S023 is performed, which comprises: the control unit 150 activating off the driving of the at least one inflow unit 140, for ceasing pouring the newly-added slurry 144 into the pulp tank 110. In one preferred embodiment, the physical feature data 155 is a real slurry-liquid-surface level value H0, the first condition is that the real slurry-liquid-surface level value H0 is less than a first preset slurry-liquid-surface level value H1, and the second condition is that the real slurry-liquid-surface level value H0 is larger than or equal to the first preset slurry-liquid-surface level value H1. In another preferred embodiment, the physical feature data 155 is a real slurry liquid pressure value, the first condition is that the real slurry liquid pressure value is less than a first preset slurry liquid pressure value, and the second condition is that the real slurry liquid pressure value is larger than or equal to the first preset slurry liquid pressure value.

Next, in a step S030 after performing the step S023, the control unit 150 controls an activating unit 160 to drive a dredging-slurry die base 120 to descend until at least one dredging die 122 of the dredging-slurry die base 120 is sunk below a slurry-liquid-surface 115 of the slurry 114 within the pulp tank 110, for dredging a portion of the slurry 114 into the at least one dredging die 122; meanwhile, the real slurry-liquid-surface level value will be gradually raised from H0 to H3 (as shown in FIGS. 2-3).

Next, in a performed step S040, the control unit 150 controls a vacuum device 170 to evacuate a solvent 118 contained in the slurry 114 dredged within the at least one dredging die 122 of the dredging-slurry die base 120 by a vacuum pressure, except only retaining a solid matter 119 contained in the slurry 114 within the at least one dredging die 122, wherein the vacuum device 170 is fluid-communicated to the dredging-slurry die base 120. Take a depth detector as an example, when the solvent 118 contained in the slurry 114 is evacuated, the real slurry-liquid-surface level value will gradually fall down from H3 (as shown in FIGS. 3-4).

Next, in a performed step S050, when the control unit determines that the physical feature data 155 meets with a third condition, the control unit 150 controls the activating unit 160 to drive the dredging-slurry die base 120 to ascend until the at least one dredging die 122 along with the solid matter 119 dredged by itself are moved above the slurry-liquid-surface 155. In the embodiment, the third condition is that the slurry-liquid-surface level value is less than or equal to a second preset slurry-liquid-surface level value and/or a capacity of the evacuated solvent is equal to a preset capacity. As shown in FIGS. 3-4, after the vacuum device 170 vacuum evacuates the solvent 118, the real slurry-liquid-surface level value H3 is decreased approaching the second preset slurry-liquid-surface level value H2. In another embodiment, the third condition is that the real slurry liquid pressure value is less than or equal to a slurry liquid pressure value and/or a capacity of the evacuated solvent 118 is equal to a preset capacity. Furthermore, when the at least one dredging die 122 is moved above the slurry-liquid-surface 115, along with the solid matter, as shown in FIGS. 4-5, the real slurry-liquid-surface level value will be decreased from H3 to H4. Then, back to the steps S01 and S021 for performing the detection of the slurry physical feature and so forth in repeated cycles. When the real slurry-liquid-surface level value H4 is less than the first preset slurry-liquid-surface level value H1, the control unit 150 activates on the driving of the at least one inflow unit 140, for pouring the newly-added slurry 144 into the pulp tank 110.

As described above, although the present invention has been described with the preferred embodiments thereof, those skilled in the art will appreciate that various modifications, additions, and substitutions are possible without departing from the scope and the spirit of the invention. Accordingly, the scope of the present invention is intended to be defined only by reference to the claims.

What is claimed is:

1. A dredging slurry system with a pulp tank, which is applied for a paper pulp molding equipment, comprising:

the pulp tank, constructed of a plurality of tank walls which jointly define a storage space for storing a slurry therein;

a dredging-slurry die base, disposed with at least one dredging die; and an activating unit, used during a plurality of different stages, for driving the dredging-slurry die base to descend until the at least one dredging die is sunk below a liquid-surface of the slurry within the pulp tank and thereby dredging a portion of the slurry into the at least one dredging die, or for driving the dredging-slurry die base to ascend from below the slurry-liquid-surface until above the slurry-liquid-surface;

wherein the dredging slurry system with the pulp tank, further comprises:

a slurry-physical-feature detection unit, configured to detect at least one physical feature of the slurry within the pulp tank, during the plurality of different stages, and to output a physical feature data corresponding to the at least one physical feature;

at least one inflow unit, used for selectively pouring a newly-added slurry into the pulp tank through at least one inlet of the pulp tank; and a control unit, configured to activate on driving of the at least one inflow unit, for pouring the newly-added slurry into the pulp tank, when the physical feature data meets with a first condition, and to activate off the driving of the at least one inflow unit, for ceasing pouring the newly-added slurry into the pulp tank, when the physical feature data meets with a second condition.

2. The dredging slurry system with the pulp tank according to claim 1, wherein the slurry-physical-feature detection unit is at least one pressure meter, the at least one physical feature is a liquid pressure of the slurry within the pulp tank, and the physical feature data is a real slurry liquid pressure value.

3. The dredging slurry system with the pulp tank according to claim 2, wherein the first condition is that the real slurry liquid pressure value is less than a first preset slurry liquid pressure value, and the second condition is that the real slurry liquid pressure value is larger than or equal to the first preset slurry liquid pressure value.

4. The dredging slurry system with the pulp tank according to claim 2, wherein the control unit generates a real slurry-liquid-surface level value according to the real slurry liquid pressure value, the first condition is that the real slurry-liquid-surface level value is less than a first preset slurry-liquid-surface level value, and the second condition is that the real slurry-liquid-surface level value is larger than or equal to the first preset slurry-liquid-surface level value.

5. The dredging slurry system with the pulp tank according to claim 2, wherein the slurry-physical-feature detection unit is at least one depth detector, the at least one physical feature is a liquid-surface level of the slurry within the pulp tank, the physical feature data is a real slurry-liquid-surface level value.

6. The dredging slurry system with the pulp tank according to claim 5, wherein the first condition is that the real slurry-liquid-surface level value is less than a first preset slurry-liquid-surface level value, and the second condition is that the real slurry-liquid-surface level value is larger than or equal to the first preset slurry-liquid-surface level value.

7. The dredging slurry system with the pulp tank according to claim 6, wherein after the control unit activates off the driving of the at least one inflow unit, for ceasing pouring the newly-added slurry into the pulp tank, the control unit controls the activating unit to drive the dredging-slurry die base to descend until the at least one dredging die is sunk below a liquid-surface of the slurry within the pulp tank, for dredging a portion of the slurry into the at least one dredging die.

8. The dredging slurry system with the pulp tank according to claim 6, further comprising a vacuum device fluid-communicated to the dredging-slurry die base, wherein the control unit controls the vacuum device to evacuate a solvent contained in the slurry dredged in the at least one dredging die of the dredging-slurry die base by a vacuum pressure, except only retaining a solid matter contained in the slurry within the at least one dredging die.

9. The dredging slurry system with the pulp tank according to claim 8, wherein an error value between dried weights of the solid matters retained in each two of the at least one dredging die, in relation to a desired weight, is within plus or minus 3%.

10. The dredging slurry system with the pulp tank according to claim 8, wherein when the physical feature data meets with a third condition, the control unit controls the activating unit to drive the dredging-slurry die base to ascend above the slurry-liquid-surface.

11. The dredging slurry system with the pulp tank according to claim 10, wherein the third condition is that the slurry-liquid-surface level value is less than or equal to a second preset slurry-liquid-surface level value and/or a capacity of the evacuated solvent is equal to a preset capacity.

12. The dredging slurry system with the pulp tank according to claim 6, wherein the pulp tank merely has a unidirectional fluid communication to an exterior thereof, by means of arrangement of the at least one inflow unit.

* * * * *